US006616721B2

(12) United States Patent
Oh

(10) Patent No.: US 6,616,721 B2
(45) Date of Patent: Sep. 9, 2003

(54) CYCLONE DUST COLLECTOR FOR PREVENTING BACKFLOW

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/079,225

(22) Filed: Feb. 20, 2002

(65) Prior Publication Data

US 2003/0051452 A1 Mar. 20, 2003

(30) Foreign Application Priority Data

Sep. 17, 2001 (KR) ..... 2001-57086

(51) Int. Cl.[7] ..... B01D 45/12

(52) U.S. Cl. ..... 55/426; 55/429; 55/459.1; 55/DIG. 3

(58) Field of Search ..... 55/424, 426, 429, 55/459.1, DIG. 3

(56) References Cited

U.S. PATENT DOCUMENTS 6,461,508 B1 * 10/2002 Thomson ..... 210/512.1

FOREIGN PATENT DOCUMENTS

GB 2364940 2/2002

* cited by examiner

*Primary Examiner*—Robert A. Hopkins
(74) *Attorney, Agent, or Firm*—Ladas & Parry

(57) ABSTRACT

A cyclone dust collecting apparatus of a vacuum cleaner has: a cylindrical-type cyclone body for centrifugally separating dust entrained in air drawn into the cyclone body from the outside through a suction pipe and for discharging clean air through a discharge pipe, a dust collector disposed at a lower part of the cyclone body in order to collect dust centrifugally separated from the air and a plurality of dust backflow and rotation prevention members protruding from the bottom of the dust collector for a predetermined length in order to prevent the dust collected at the bottom of the dust collector from being circulated in the cyclone body. According to the cyclone dust collecting apparatus of the vacuum cleaner having the above construction, circulation of the dust collected at the bottom of the dust collector is prevented, and the dust is not discharged through the discharge pipe, thus the dust collection efficiency of the cyclone dust collecting apparatus is improved.

5 Claims, 4 Drawing Sheets

CYCLONE DUST COLLECTOR FOR PREVENTING BACKFLOW

BACKGROUND OF THE INVENTION

1. Field of the Invention

The present invention relates generally to a vacuum cleaner, and more particularly to a cyclone dust collecting apparatus for a vacuum cleaner that centrifugally separates an air drawn into with a dust on a cleaning surface.

2. Description of the Related Art

Generally, a vacuum cleaner having a cyclone dust collecting apparatus includes a cleaner body, a suction unit, and the cyclone dust collecting apparatus. The cyclone dust collecting apparatus includes a cyclone body, a suction pipe, a discharge pipe, and a dust collector. The cyclone body provides a space for air drawn into the cyclone body from outside through the suction pipe to centrifugally separate the dust entrained in the air, and centrifugally separated clean air is discharged to outside of the cyclone body through the discharge pipe. The dust collector is connected to a lower end of the cyclone body and is used to collect the dust separated from the air.

The operation of a conventional cyclone dust collecting apparatus 20 will be described with reference to FIG. 1.

The air drawn from the surface to be cleaned is drawn by a suction unit (not shown) into the cyclone body 21 through the suction pipe 27. The air guided into the cyclone body 21 flows downwardly by whirling along a side wall of the cyclone body 21, as shown by the arrows. The current velocity of some of the air whirling near to the side wall of the cyclone body 21 decreases due to the fluid friction with the side wall. Accordingly, dust, which is entrained in the air, comes into contact with the side wall of the cyclone body 21 due to a centrifugal force of the air, becomes slower moving and is collected by gravitation in the dust collector 23 connected with a lower part of the cyclone body 21 by falling downwardly along the side wall of the cyclone body 21.

On the other hand, as described above, the air backflows upwardly again after reaching the bottom 23*a* of the dust collector 23. The current velocity of the flowing air at the bottom 23*a* of the dust collector 23 is minimized when the air reaches the bottom 23*a* in the cyclone dust collecting apparatus 20. Therefore, fine dust entrained in the air that backflows upwardly becomes separated, and the fine dust is collected with the dust previously collected at the bottom 23*a* of the dust collector 23. The clean air from which the dust has been removed is discharged to the outside of the cyclone body 21 through the discharge pipe 25.

However, although the current velocity of the air at the bottom 23*a* of the dust collector 23 is minimized, the air whirls at a low velocity at the bottom 23*a* by the effect of the centrifugal force generated before reaching the bottom 23*a* after the dust is separated. Accordingly, the dust collected at the bottom 23*a* continuously flows since the dust is not stabilized. The fine dust collected at the bottom 23*a* may again be picked up by the flowing air together with other dust, such as a hair of a person or an animal. In addition, when a large amount of dust is collected in the dust collector 23, such reflow of dust is aggravated.

Therefore, as described above, in a conventional cyclone dust collecting apparatus 20, the problem of dust backflow phenomenon results in flowing dust being discharged to the outside with the clean air through the discharge pipe 25.

SUMMARY OF THE INVENTION

An object of the present invention is to provide a cyclone dust collecting apparatus for a vacuum cleaner having an improved structure for dust collection by preventing dust, which is collected after being centrifugally separated from the air in the cyclone body, from again becoming entrained in the air stream.

The above object is accomplished by providing a cyclone dust collecting apparatus including: a cylindrical-type cyclone body for centrifugally separating dust entrained in air drawn into the cylindrical-type cyclone body from outside through a suction pipe and discharging clean air through a discharge pipe; a dust collector disposed at a lower part of the cyclone body in order to collect a dust centrifugally separated from the air; and a plurality of dust backflow and rotation prevention members protruded from a bottom of the dust collector for a predetermined length.

In addition, it is preferable that the dust backflow and rotation prevention members comprise pillars-having a non-circular cross-sectional area.

Moreover, it is advisable that the dust backflow and rotation prevention members are disposed radially at the bottom of the dust collector to have a predetermined distance from the center of the bottom, and to have the same angle with a predetermined degree of separation relative to each other.

It is more preferable that the dust backflow and rotation prevention members protrude from the bottom of the dust collector with a ratio of ¼ to ½ relative to the height of the dust collector.

According to the cyclone dust collecting apparatus of the present invention having the above construction, the dust collected at the bottom of the dust collector is prevented from becoming entrained in the whirling clean air stream. Therefore, the dust in the dust collector is inhibited from being backflown to the discharge pipe with the clean air.

BRIEF DESCRIPTION OF THE DRAWINGS

The object and the feature of the present invention will be more apparent by describing the preferred embodiments of the present invention by reference to the appended drawings, in which.

DETAILED DESCRIPTION OF THE PREFERRED EMBODIMENTS

Hereinbelow, the preferred embodiments of the present invention will be described in greater detail by referring to the appended drawings.

Figure 2:
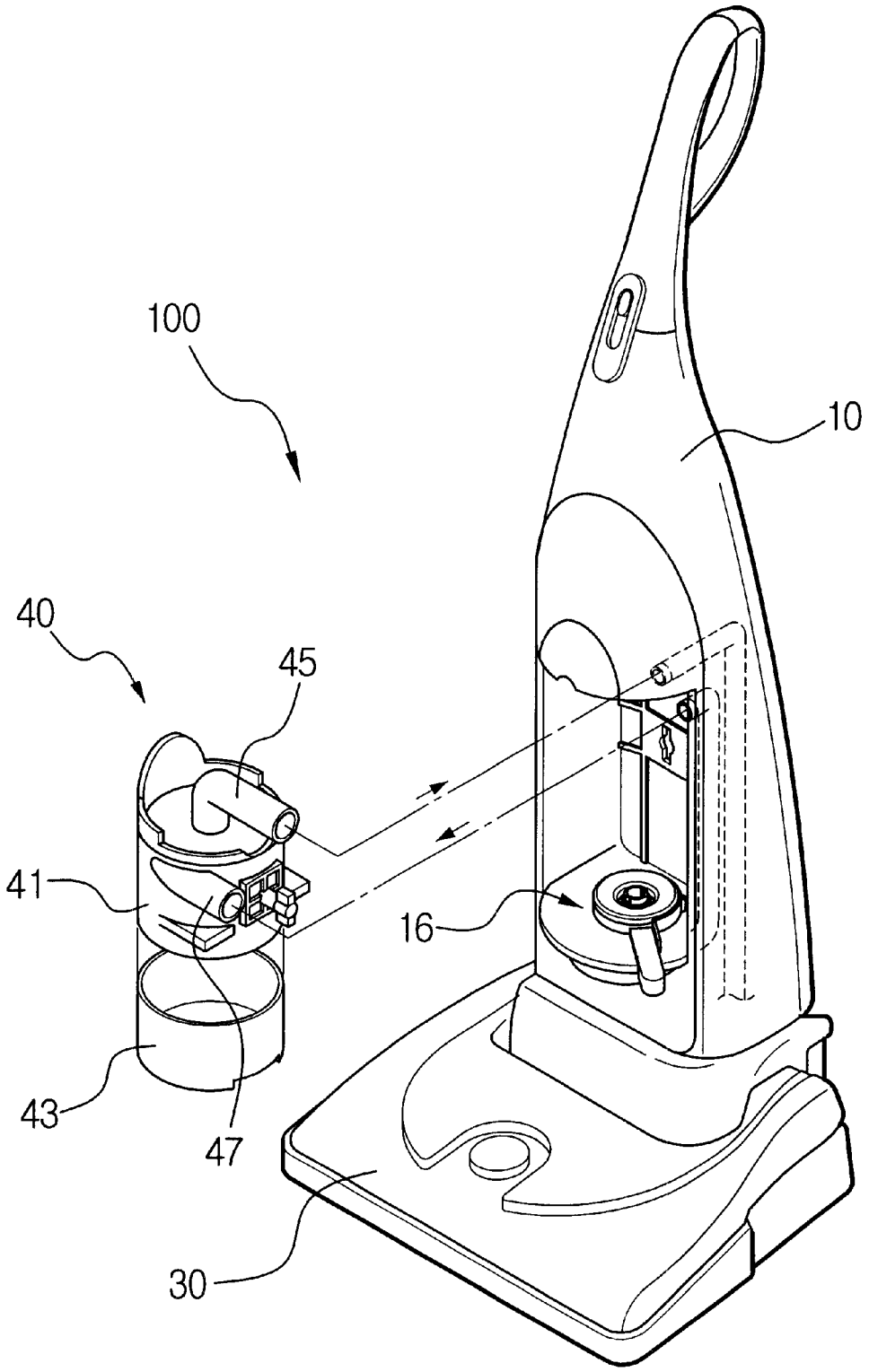
FIG. 2 is a partially exploded perspective view showing a vacuum cleaner having a cyclone dust collecting apparatus according to the present invention.

FIG. 2 shows an upright-type vacuum cleaner 100 having a cyclone dust collecting apparatus 40 according to a first preferred embodiment of the present invention. Referring to FIG. 2, the vacuum cleaner 100 includes a suction unit 30 for drawing dust and an from a surface to be cleaned, and a cleaner body 10 having a built-in fan motor (not shown) for providing a suction force to the suction unit 30. In addition, the vacuum cleaner 100 further includes a cyclone dust collecting apparatus 40 for providing improved dust collection efficiency. The cyclone dust collecting apparatus 40 includes a cyclone body 41, a dust collector 43, a suction pipe 47, and a discharge pipe 45. A lever 16 is used for mounting on and removing the cyclone dust collecting apparatus from the cleaner body 10.

The cyclone body 41 centrifugally separates air drawn into from the outside environment through the suction pipe 47, and the discharge pipe 45 discharges clean air, which has had dust centrifugally separated therefrom in the cyclone body 41, to outside of the cyclone body 41.

The dust collector 43 collects the dust separated from the air whirling in the cyclone body 41, and is itself connected with a lower part of the cyclone body 41. The dust collector 43 in the preferred embodiment of the present invention is removably connected with the cyclone body 41. When using the cyclone dust collecting apparatus 40, in which the dust collector 43 is removably connected with the cyclone body 41, a user can easily remove the dust collected in the dust collector 43, after separating the dust collector 43 from the cyclone body 41 after using the vacuum cleaner 100.

Figure 3:
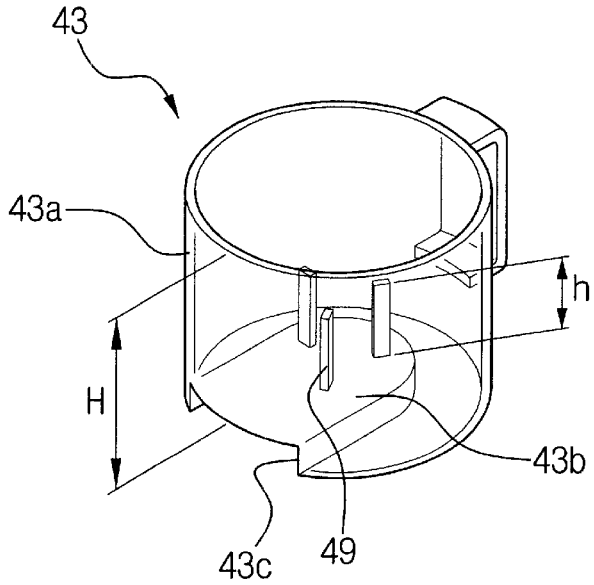
FIG. 3 is a perspective view showing a dust collector of the cyclone dust collecting apparatus according to a first preferred embodiment of the present invention.

In the meantime, as shown in FIG. 3, the dust collector 43 includes a cylindrical-type side wall 43*a*, and a bottom 43*b* for covering a lower end of the side wall 43*a*. An opening in the side wall 43*a* is connected with a lower end of the cyclone body 41. In addition, the dust collector 43 further includes at least one dust backflow and rotation prevention member 49 for preventing the collected dust from being entrained within the whirling air after being drawn into the dust collector 43. A groove 43*c* in the wall 43*a* is adjacent the bottom 43*b* and is provided for attaching and removing the dust collector 43 by the lever 16.

The dust backflow and rotation prevention member 49 in the preferred embodiment includes a plurality of protrusion members 49 perpendicularly protruded from the bottom 43*b* of the dust collector 43. The protrusion members 49 are each shown as being formed as a pillar having the sectional area of a rectangle, but the protrusion members 49 can apply other types of various non-circular sectional areas. Moreover, each protrusion member 49 preferably is radially disposed at a predetermined radius from the center of the bottom 43*b* of the dust collector 43. Furthermore, each rectangular protrusion member 49 preferably is disposed on a straight line passing through the center locus and an edge of the bottom 43*b*. In other words, one side of the protrusion members 49 faces towards the center of the bottom 43*b*, and another side of the protrusion members 49 faces towards the outer edge of the bottom 43*b*. The protrusion members 49 are disposed symmetrically to each other. Disposing protrusion members 49 as described above, will maximize the surface area of the protrusion members 49 which can come into contact with the air whirling at the bottom 43*b*.

The protrusion members 49 protrude from the bottom 43*b* to a predetermined height, and have a height that is a predetermined ratio to the height of the dust collector 43. It is preferable that the ratio of the height of the protrusion members 49 to the height of the dust collector 43 be between about ¼ to ½. It can prevent dust from becoming entrained in the air stream circulating between the bottom 43*b* and the upper end of the protrusion members 49. Also, the function of the protrusion members 49 can be secured when the dust is collected at a lower end, rather than at the upper end, of the protrusion members 49 at the bottom 43*b*. As an example, according to the dust collector 43 shown in FIG. 3, the height 'H' of the dust collector 43 is 125 mm, and the height 'h' of the protrusion members 49 is 51 mm, thus it can be confirmed that the protrusion members 49 protrude from the bottom 43*b* and have a length within the desired ratio. Moreover, it is preferable that the protrusion members 49 are disposed for the same distance from each other, and the angle between the protrusion members 49 is differentiated in accordance with the number of the protrusion members 49. In the preferred embodiment of the present invention, there are three protrusion members 49, and accordingly, the protrusion members 49 are disposed at 120° from each other.

In the meantime, the cleaning efficiency of the cyclone dust collecting apparatus 40 can be improved at low cost, when the protrusion members 49 are added for preventing the backflow and rotation of the dust, since the protrusion members 49 can be molded integrally with the dust collector 43. Moreover, other alternative forms, besides the protrusion members 49, can be provided for the dust backflow and rotation prevention member.

Hereinbelow, the operation of the vacuum cleaner according to the first preferred embodiment of the present invention will be described by referring to the appended drawings.

Figure 1:
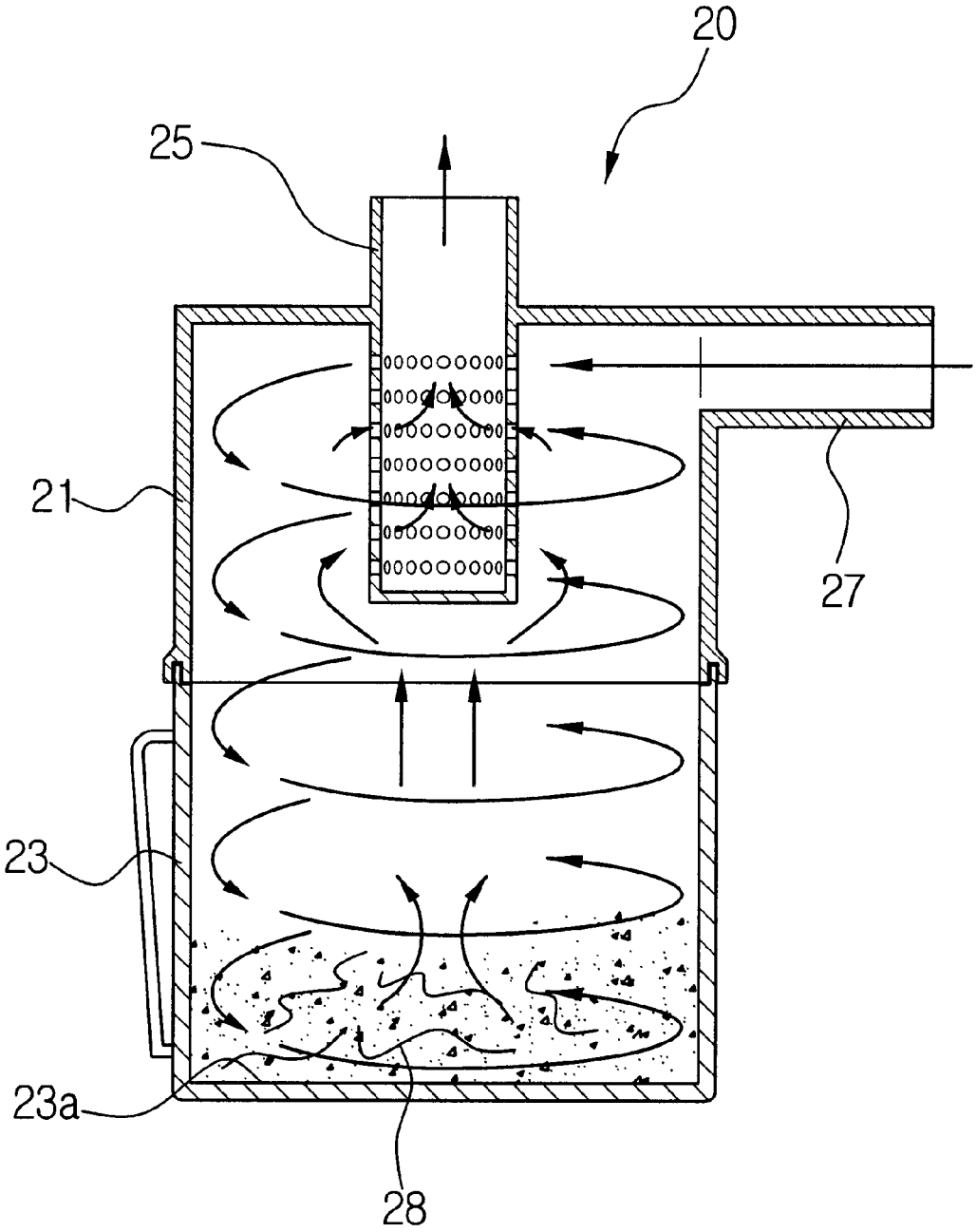
FIG. 1 (PRIOR ART)
FIG. 1 is a cross-sectional side view showing the operation of a conventional cyclone dust collecting apparatus.
Figure 4:
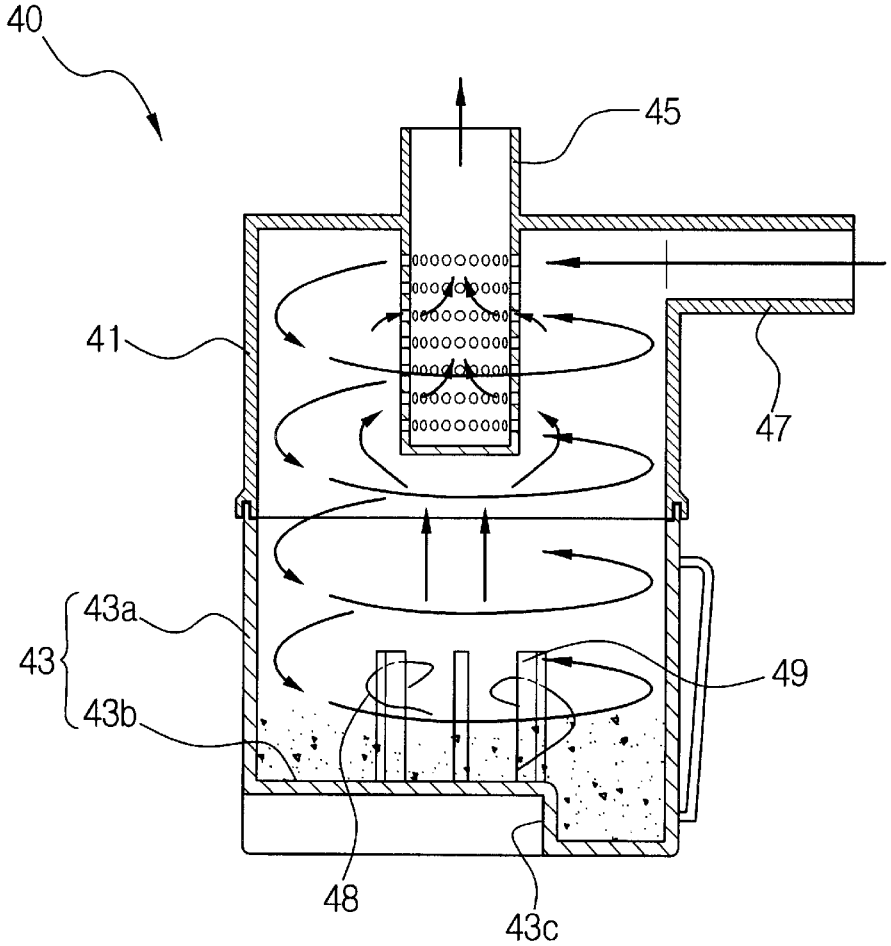
FIG. 4 is a cross-sectional side view showing the operation of the cyclone dust collecting apparatus of FIG. 3.

Referring to FIG. 4, the drawn air is drawn into the cyclone body 41 through the suction pipe 47, after being drawn into from the surface to be cleaned through the suction unit 30 (FIG. 1). The air drawn into the cyclone body 41 flows down by whirling along the side wall 41*a* of the cyclone body 41 until the air reaches the bottom 43*b* of the dust collector 43, and backflows upwardly from the bottom 43*b*.

Here, the dust is centrifugally separated from the whirling air by the centrifugal force of the air whirling along the side wall of the cyclone body 41, and since the current velocity of the air is minimized at the bottom 43*b* of the dust collector 43, even fine dust is separated from the air and collected at the bottom 43*b* of the dust collector 43. The clean air is circulated upwardly form the bottom 43*b* and is discharged to the outside of the cyclone body 41 through the discharge pipe 45.

Meanwhile, the clean air at the bottom 43*b* of the dust collector 43 still whirls at low velocity and air circulation is maintained by the suction force of the discharge pipe 45 and by the inertia of whirling. At this time, dust, such as hair of a person or an animal, collected at the bottom 43*b* can become entrained in the air stream due to the circulation of clean air at the bottom 43*b*.

However, as described above, the circulation of clean air whirling at the bottom 43*b* is prevented by the protrusion members 49, which protrude from the bottom 43*b* for a predetermined height. Moreover, the clean air circulates, regardless of the deflection caused by the protrusion members 49 at the bottom 43*b*, as shown by the dust 48 in FIG. 4, the dust 48 at the bottom 43*b* cannot flow with the whirling clean air. Therefore, the dust is prevented from being discharged with the clean air discharged to the outside of the cyclone dust collecting apparatus 40 through the discharge pipe 45.

Figure 5:
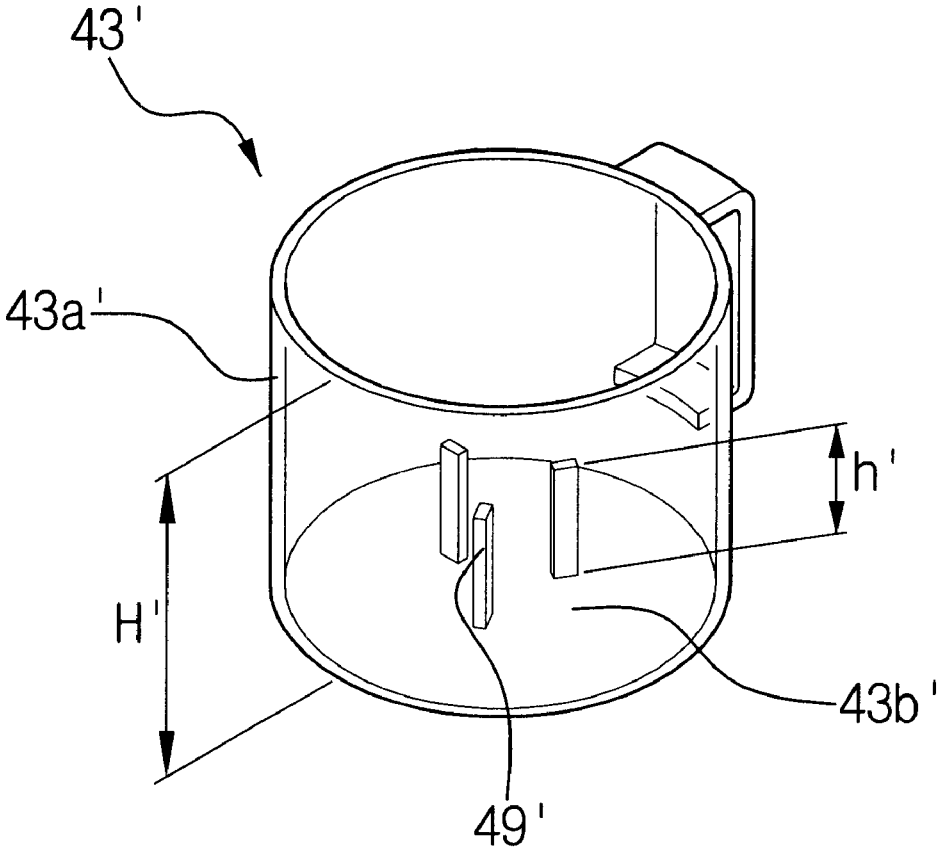
FIG. 5 is a perspective view showing a dust collector of the cyclone dust collecting apparatus according to a second preferred embodiment of the present invention.

FIG. 5 shows the dust collector 43' of the cyclone dust collecting apparatus 40 according to a second preferred embodiment of the present invention. The dust collector 43' of the second preferred embodiment is formed without the groove 43*c* for attaching and removing FIGS. 3 and 4) at the lower part of the dust collector 43', described above with reference to the first preferred embodiment of the present invention. In this embodiment, the height 'H" of the dust collector 43' is the distance from the lower end to the upper end of the dust collector 43'. The operation of the cyclone dust collecting apparatus 40' having the dust collector 43' with the above construction is essentially the same as that of the first preferred embodiment of the present invention described above, thus the description for the operation of the cyclone dust collecting apparatus according to the second preferred embodiment will be omitted.

On the other hand, only the cyclone dust collecting apparatus 40 applied to the upright-type vacuum cleaner 100 has been described, but the cyclone dust collecting apparatus 40 can be also in another type of vacuum cleaners, for example, in a canister-type vacuum cleaner.

According to the cyclone dust collecting apparatus 40 of the vacuum cleaner according to either embodiment of the present invention, as the dust backflow and rotation prevention members 49, 49' are disposed at the bottom 43*b*, 43*b*' of the dust collector 43, 43', the clean air is prevented from being whirled at the bottom 43*b*, 43*b*' of the dust collector 43, 43' after being centrifugally separated from the entrained dust in the cyclone body 41, and the dust piled at the bottom 43*b*, 43*b*' is also prevented from in becoming entrained the clean air that circulates toward the discharge pipe 45. Accordingly, the air discharged from the cyclone dust collecting apparatus can be maintained in a clean condition, and thus the dust collection efficiency of the cyclone dust collecting apparatus will be improved.

In addition, the dust collection function of the cyclone dust collecting apparatus can be improved with relatively low production cost, since the production cost increase is maintained to a minimum when disposing, removing, changing, adding, or reducing of the dust backflow and rotation prevention members 49, 49'. This is so because the dust backflow and rotation prevention members 49, 49' are preferably integrally molded with the dust collector 43, 43'.

So far, the present invention has been illustrated and described with reference to preferred embodiments. However, the present invention is not limited to the preferred embodiments described herein, and one skilled in the art can modify, alter, substitute or otherwise utilize the teachings of the present invention without distorting the point of the present invention claimed in the following claims.

What is claimed is:

1. A cyclone dust collecting apparatus of a vacuum cleaner, comprising:

a cylindric-type cyclone body for centrifugally separating an air drawn into from an outside through a suction pipe and discharging a clean air through an discharge pipe;

a dust collector disposed at a lower part of the cyclone body in order to collect a dust centrifugally separated from the air; and a plurality of dust backflow and rotation prevention members to prevent the dust collected at the bottom of the dust collector from being flown, the dust backflow and rotation prevention members protruding from the bottom of the dust collector for a predetermined length and formed in the shape of a pillar.

2. The cyclone dust collecting apparatus of claim 1, wherein the dust backflow and rotation prevention members are formed to have a non-circular sectional area.

3. The cyclone dust collecting apparatus of claim 1, wherein the dust backflow and rotation prevention members are disposed radially at the bottom of the dust collector to have a predetermined distance from a center of the bottom.

4. The cyclone dust collecting apparatus of claim 3, wherein the dust backflow and rotation prevention members are disposed to have the same angle with a predetermined degree to each other.

5. The cyclone dust collecting apparatus of claim 4, wherein the dust backflow and rotation prevention members are protruded from the bottom of the dust collector with a ratio of ¼ to ½ to a height of the dust collector.

* * * * *